United States Patent [19]

Bürkner et al.

[11] 4,380,285

[45] Apr. 19, 1983

[54] APPARATUS FOR ALIGNING CHIPS DURING THE MANUFACTURE OF CHIPBOARDS

[75] Inventors: Wolfgant Bürkner; Franz-Josef Ebert, both of Darmstadt, Fed. Rep. of Germany

[73] Assignee: Carl Schenck A.G., Fed. Rep. of Germany

[21] Appl. No.: 229,102

[22] Filed: Jan. 28, 1981

[30] Foreign Application Priority Data

May 16, 1980 [DE] Fed. Rep. of Germany ..... 3018683

[51] Int. Cl.[3] ..... B65G 47/18

[52] U.S. Cl. ..... 198/533

[58] Field of Search ..... 198/533, 396, 382; 425/81.1, 82.1, 83.1, 110

[56] References Cited

U.S. PATENT DOCUMENTS

| | | | |
|---|---|---|---|
| 2,744,045 | 5/1956 | Collins | 425/82.1 X |
| 3,487,911 | 1/1970 | Wirz | 198/533 X |
| 3,677,390 | 7/1972 | Parker et al. | 198/382 X |
| 3,714,700 | 2/1973 | Ehrenfellner | 198/382 X |
| 3,864,066 | 2/1975 | Gerhardt | 425/83.1 X |
| 3,886,629 | 6/1975 | Nakai et al. | 425/83.1 |
| 3,896,536 | 7/1975 | Keller et al. | 198/382 X |
| 4,058,201 | 11/1977 | Etzold | 198/382 |

FOREIGN PATENT DOCUMENTS

| | | | |
|---|---|---|---|
| 976840 | 6/1964 | Fed. Rep. of Germany . | |
| 2535382 | 2/1978 | Fed. Rep. of Germany . | |
| 2734403 | 12/1979 | Fed. Rep. of Germany . | |
| 816285 | 7/1959 | United Kingdom | 198/382 |

*Primary Examiner*—Jeffrey V. Nase
*Assistant Examiner*—Dennis J. Williamson
*Attorney, Agent, or Firm*—Connolly and Hutz

[57] ABSTRACT

The present invention relates to an apparatus for longitudinally aligning particles, such as chips during the manufacture of chipboards, into a preferred direction by means of parallel, vertical aligning plates spaced apart from each other. Sets of alternating spiked and solid discs are mounted above the vertical aligning plates intermeshing with them to prevent clogging and facilitates longitudinal alignment of the particles being fed. The solid discs may have different diameters to facilitate flow. Preloosening rollers are mounted above the aforementioned disc rollers at different levels to more uniformly distribute particles. The central preloosening rollers slightly overlap each other and rotate in opposite directions. Outer preloosening rollers also rotate in opposite directions.

10 Claims, 3 Drawing Figures

APPARATUS FOR ALIGNING CHIPS DURING THE MANUFACTURE OF CHIPBOARDS

BACKGROUND OF THE INVENTION

A device for aligning lignocellulose-containing particles provided with a binder is known from West German Offenlegungsschrift No. 2,734,403, in which vertical orienting plates, mounted above a shaping conveyor, serve as chute grids for the aligned deposition of chips. The vertical aligning plates are movable relative to each other and are provided with elevations on the side away from the shaping conveyor, in order to turn the chips, which come from a preloosening unit aligned transversely to the preferred direction, into the preferred longitudinal direction. It is unavoidable in this process that the chips to be deposited bend off and come to rest on the narrow edge of the vertical surface and thus cause clogging of the spaces between the vertical aligning plates. Such a clogging cannot be eliminated, because even though the protuberance-like projections cause a bending off of the chips to be aligned, they do not cause a separation, and thus only speed up the clogging process.

It has already been proposed (West German Pat. No. 976,840) to use grids placed in oblique position for the longitudinal orientation of the chips, or to use grates, in which the chip material not falling through the grid or the grate shall be caught and returned at the end of the oblique grid.

In such a device, a trouble-free operation of the plant is impossible especially because of the sized chip material, and the clogging of the grates is also not counteracted.

The known state of the art gives no indication of how a uniform passage of chip material to be aligned through grids or vertical orienting plates shall take place; the site of deposition of the aligned material is left to chance, which inherently leads to various defects.

A device has become known through West German Auslegeschrift No. 2,535,382, in which plate discs are mounted above a shaping support, and in which the overlapping disc rolls are provided with catching lugs in order to prevent the rollers frame from clogging. Here, too, the passages takes place uncontrolled over a great length of the shaping support, caused especially by dead corners, in which the material to be aligned dances around until it is pulled into a gap by a catching tooth. In addition, such disc rolls must have the smallest possible diameter in order to keep the dead corners at a minimum. The guidance of the oriented chip material is minimal, because open pockets are formed on the plate disc end turned toward the shaping conveyor, in which pockets the previously aligned chips resume a non-aligned position, and thus considerably reduce the degree of alignment. As was already mentioned, non-aligned material is discharged at the end of a set of such disc rolls in this case as well.

SUMMARY OF THE INVENTION

In view of this state of the art, the present invention has the basic task of longitudinally aligning chips for the manufacture of chipboards and depositing the chips in this position, with preferred deposition of the large-surface chips in the outer zone of a given layer. This task is accomplished according to the present invention in that spacing rings, spiked discs, solid discs and spiked discs are mounted alternately and in this order on parallel rotating shafts spaced apart from each other above the orienting plates and perpendicular to the preferred direction. Due to the arrangement of spacing rings in connection with alignment plates and in connection with spiked discs, it is achieved that neither pockets open toward the support are formed, nor dead corners or dead pockets above the rolls, and a reliable chip passage is achieved without bent chips being liable to deposit on the plates and thus being able to cause the clogging of the flow passage.

In the embodiment of the present invention, it is proposed that the solid discs mounted on one shaft have different diameters. Due to the different diameters, a better intake into the drop passage is achieved, because the spacing between the solid discs is greater than the length of the chips being aligned.

In another embodiment of the object of the present invention, it is proposed that the aligning plates penetrate into the disc roll in the zone of the spacing rings.

In another embodiment, it is proposed that the diameters of the spiked discs be equal to each other and greater than the largest diameter of a solid disc. Thus a definite cleaning of the upper pockets is achieved without any further transport of the chips being aligned to another roll.

In another embodiment of the object of the present invention, it is proposed that at least the last shaft of the shafts mounted one behind another rotate in the opposite sense. Through this selection of rotation in the opposite sense for the last roll assembly, a reliable passage of the material being aligned within a set and within the drop zone is inherently achieved.

If larger amounts of material to be sorted are to be deposited in aligned fashion in such a device, for deposition of large surface chips in the outer zone of the given layer is intended, it is proposed according to the present invention to mount preloosening rolls above the disc rolls.

One embodiment consists in that at least two preloosening rolls are rotating simultaneously in the same direction at different heights above the disc rolls, whereby a favorable distributing effect is achieved. It is proposed in another embodiment that another pair of preloosening rolls be mounted as mirror images of preloosening rolls rotating in the same direction. The throughput is increased considerably by the symmetrical arrangement of the preloosening rolls, also with respect to the aligning rolls mounted behind the preloosening rolls. In another embodiment of the object of the present invention, it is proposed that the opposite preloosening rolls mounted at the same height overlap each other partially. A definite division of the chip flow being aligned is achieved by the partial overlap, and this the desired division is made possible in both directions. Thus, a uniform double flow, which always has the same composition, is obtained from a great overall material flow.

BRIEF DESCRIPTION OF THE DRAWINGS

Novel features and advantages of the present invention will become apparent to one skilled in the art from a reading of the following detailed description in conjunction with the accompanying drawings wherein similar reference characters refer to similar parts and in which.

DESCRIPTION OF THE PREFERRED EMBODIMENTS

Figure 1:
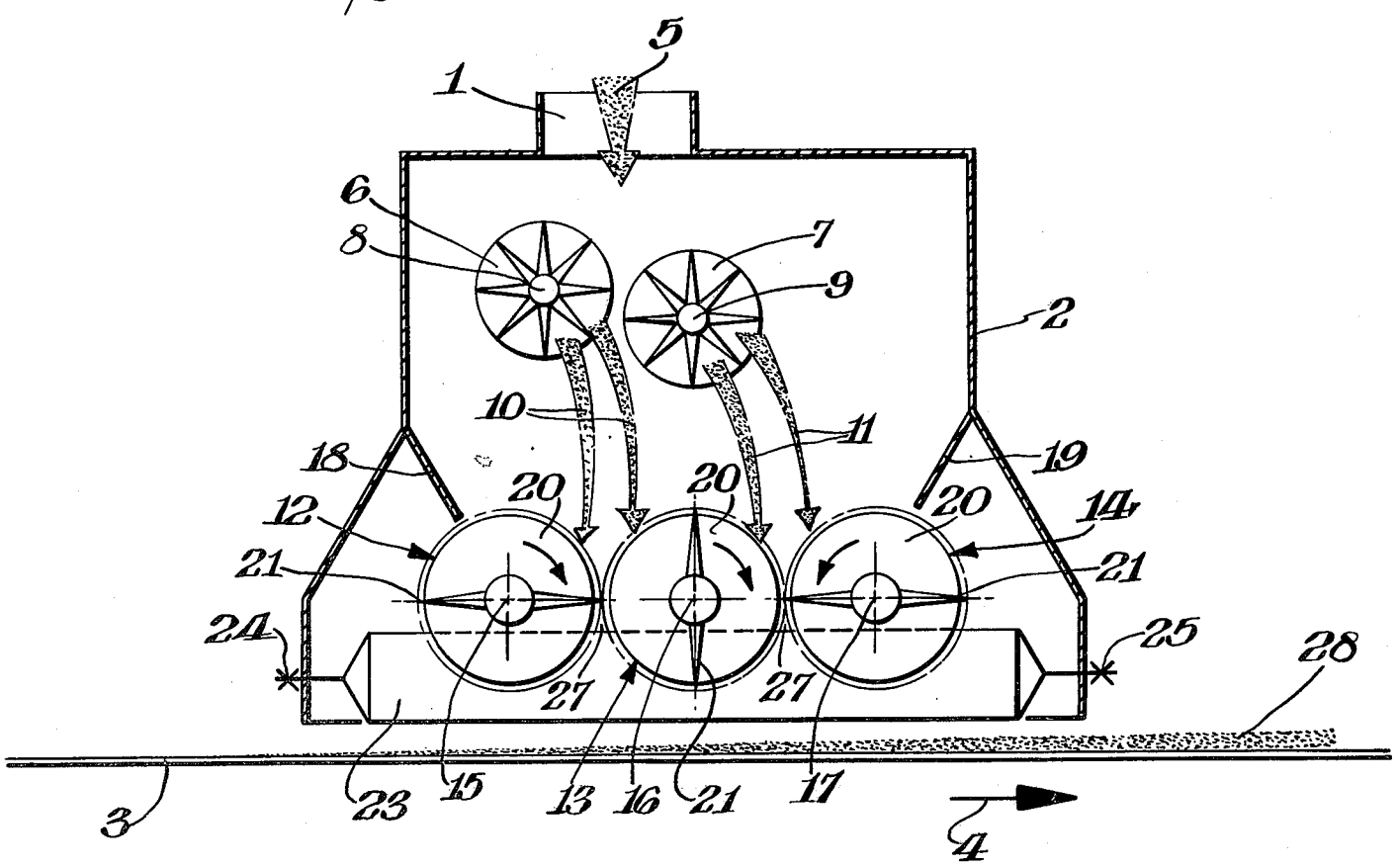
FIG. 1 is cross-sectional side view in elevation of an aligning apparatus according to the present invention.

According to FIG. 1, chips 5 to be aligned are introduced over the entire width of shaping conveyor 3, which is driven in the direction of arrow 4. These chips 5 to be aligned drop onto a pair of preloosening rolls 6, 7, which are mounted at a certain distance below opening 1, and which, like housing 2 and opening 1, extend over the entire width of shaping conveyor 3. In the embodiment according to FIG. 1, axis of rotation 8 of the preloosening roll 6 is located in a horizontal plane different from that of axis of rotation 9 of preloosening roll 7. Both preloosening rolls 6, 7 are spiked rollers, and a preloosening of the chips 5 to be aligned takes place due to the different planes of the axes of rotation, so that the spikes of the preloosening roller 7 preferably feed the larger chips to be aligned in the direction of arrows 10 and 11 to an assembly of disc rolls 12, 13 and 14.

Figure 2:
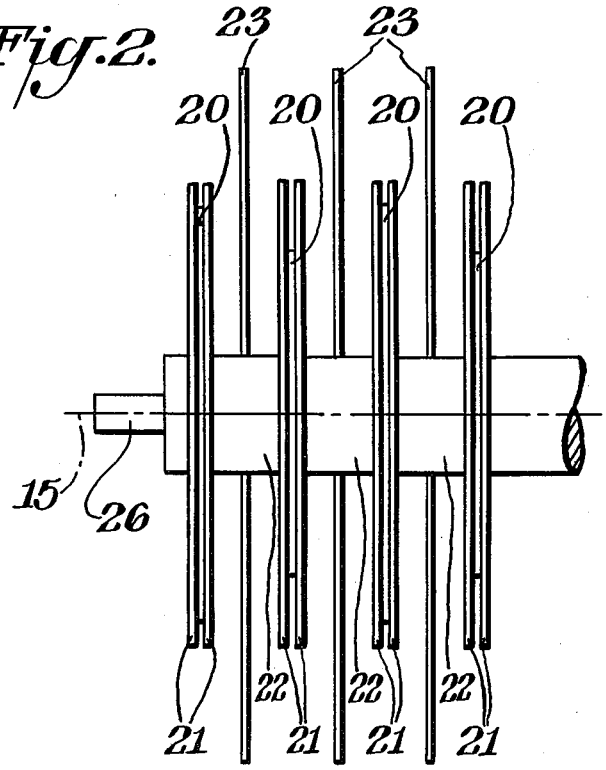
FIG. 2 is an enlarged top plan view of a disk roll portion of the apparatus shown in FIG. 1.

Disc rolls 12, 13 and 14 lie in a horizontal plane with their shaft axes 15, 16, 17 and thus form a roller set which is bounded by inclined feed plates 18, 19. Disc rolls 12 and 13 rotate clockwise according to the embodiment, while disc roll 14 rotates counterclockwise. The rotational speed of all three disc rolls 12, 13 and 14 is equal, and as is described in more detail in FIG. 2. The chips 5 to be aligned are aligned by sets of spaced disc rolls 12–14 and fed to a set of vertical spaced aligning plates 23 located below and between the laterally spaced disc rolls 12–14. Parallel spaced disc rolls 12–14 consist of a pair of spiked discs 21 and an intermediate solid disc 20. The lateral spacing of the disc rolls 12–14 is maintained by spacing rings 22 as shown in FIG. 2. Vertical aligning plates 23 extend in the direction of the shaping conveyor 3 and are braced against housing 2 by means of prestressing device 24, 25. Due to the parallel arrangement of aligning plates 23, a grid area is created, which extends over the entire width of shaping conveyor 3 and through which the aligned chips are deposited on shaping conveyor 3 without losing their alignment in the direction of movement of shaping conveyor 3 once they have assumed it.

FIG. 2 shows an enlarged view of a disc roll according to the present invention, whose axis 15 of shaft 26 is perpendicular to the vertical aligning plates 23. On disc core shaft 26, which is mounted in a bearing (not shown), namely to the left and to the right of shaping conveyor 3 in housing 2, are mounted, in always the same order, spiked disc 21, solid disc 20, spiked disc 21, spacing ring 22, spiked disc 21, etc. Spiked discs 21 have the same diameter, which is greater than the largest diameter of solid discs 20, while solid discs 20 have different diameters in order to guarantee the smooth feed of aligned chips. Spacing rings 22 also have the same diameter, and their length is such that the distance between the solid discs is greater than the largest length of the chips to be aligned. It is thus achieved that no clogging occurs on the periphery of the solid discs even at high feed rates.

In addition, the different diameters of the solid discs permit the tilting of the chips being oriented, so that they can be easily fed to the grid, which is formed of vertical aligning plates 23. Spiked discs 21 mounted to the left and to the right of solid disc 20, which spiked discs have two spikes according to one form of the present invention, bring about additionally the cleaning of the vertical edges of aligning plates 23 from the chips to be aligned which may adhere to them, and also enable the positive feed of aligned chips to the aligning grid, in spite of the existence of pockets 27, (cf. FIG. 1 where it is shown exageratedly enlarged). As is also shown in FIG. 2, the individual vertical aligning plates 23 which are parallel to each other, are centrally spaced between two solid discs 20. The distance mutually between vertical aligning plates 23 is such that an aligned chip can be deposited without obstacle, but guided in the preferred direction in chip mat 28.

As shown in FIG. 1, the lower edge of the vertical alignment plates 23 is just slightly above mat 28, so that the initially assumed alignment of individual chips is not disturbed between the exit from the plate grid and deposition on the mat. To improve the guiding effect, prestressing device 24 can be shifted on housing 2 downwardly according to the present invention to the extent that there is only a minimal gap between empty shaping conveyor 3 and vertical alignment plates 23, while prestressing device 25 is mounted on housing 2 at such a height that the lower edge of the vertical alignment grids terminate just slightly above the finished mat.

The vertical extension of the alignment plates 23 is chosen such that the alignment chips fed in by the disc rolls travel over a path of sufficient length in order to be deposited on the mat in horizontal position.

Figure 3:
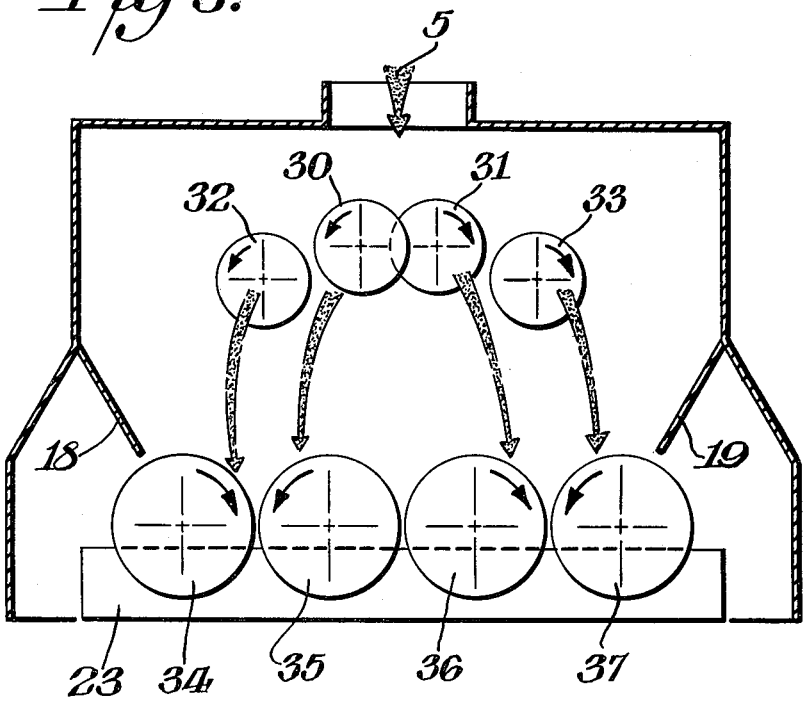
FIG. 3 is a schematic cross-sectional view in elevation of another aligning apparatus according to the present invention.

The orienting device shown in FIG. 3 has preloosening rollers 30, 31 rotating in opposite direction which roller mutually overlap each other and which are mounted centrally underneath the alignment chip 5 feed, so that the chips being aligned are positively divided to the left and to the right. In a lower horizontal plane, preloosening rollers 30, 31, which rotate in opposite senses, are followed by further preloosening rollers 32, 33 which interacting in the same sense with the given preloosening rollers rotating in opposite sense, carry out the preliminary separation of the chips to be aligned according to size, and feed the chip portions thus separated to disc roll pairs 34, 35 and 36, 37 respectively. Disc roll pairs 34, 35 and 36, 37 cause, due to their rotating in opposite directions, a clear feed of the chips being aligned to aligning plates 23, and the rotation in opposite senses simultaneously prevents the sticking of the chips being aligned to inclined guide plates 18 and 19.

What is claimed is:

1. An apparatus for aligning particles in a preferred longitudinal direction on a moving substrate comprising a housing having an inlet and an outlet, the outlet being disposed above the moving substrate, a set of parallel substantially vertical aligning plates spaced from each other being mounted immediately within the outlet, sets of solid discs flanked by spiked discs being rotatably mounted above the set of aligning plates and substantially parallel to the preferred longitudinal direction and the sets of discs being spaced from each other and disposed at least in part above and over the aligning plates, whereby the particles are fed to the aligning plates in a substantially aligned manner which is maintained by the aligning plates.

2. An apparatus as set forth in claim 1, wherein the sets of discs are mounted on several shafts which are rotatably mounted in the housing, and the solid discs on at least one of the shafts have different diameters.

3. An apparatus as set forth in any one of claims 1 or 2, wherein the aligning plates are disposed to intermesh with the sets of discs.

4. An apparatus as set forth in claim 1, wherein spacing rings are inserted between sets of discs, and the aligning plates are disposed to penetrate between the sets of discs in the region of the spacing rings.

5. An apparatus as set forth in claim 1, wherein the spiked discs have substantially the same diameter, which is larger than the largest diameter of the solid discs.

6. An apparatus as set forth in claim 1, wherein the sets of discs have one aligned sets of discs in the last position relative to the preferred direction of movement of the substrate and the aligned set of discs in the last position rotating in an opposite direction than the other sets of discs.

7. An apparatus as set forth in claim 1, wherein auxiliary aligned preloosening discs are mounted between the inlet and the aforementioned sets of discs.

8. An apparatus as set forth in claim 7, wherein at least two sets of preloosening discs are mounted at different heights above the aforementioned sets of discs and the sets of preloosening discs have means for rotating them in the same direction.

9. An apparatus as set forth in claim 7, wherein four sets of preloosening discs are provided, the sets of preloosening discs comprising two outer pairs of sets of preloosening discs, each of the outer pairs comprising mirror images of the other and comprising the sets of preloosening discs rotating in the same direction at different heights.

10. An apparatus as set forth in claim 9, wherein the two pairs of sets of preloosening rolls have adjacent aligned sets mounted at the same height and rotating in opposite directions with the adjacent sets of rolls partially overlapping each other.

* * * * *